US006890359B1

(12) United States Patent
Schneider et al.

(10) Patent No.: US 6,890,359 B1
(45) Date of Patent: May 10, 2005

(54) LIGHTENING DYED TEXTILE MATERIAL

(75) Inventors: Reinhard Schneider, Fussgönheim (DE); Peter Maier, Stuttgart (DE); Eberhard Beckmann, Neustadt (DE); Ulrich Karl, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 304 days.

(21) Appl. No.: 09/644,220

(22) Filed: Aug. 23, 2000

(30) Foreign Application Priority Data

Aug. 24, 1999 (DE) ..... 199 40 068

(51) Int. Cl.[7] ..... D06L 3/00; D06L 3/10
(52) U.S. Cl. ..... 8/102; 8/110; 8/111
(58) Field of Search ..... 8/102, 110, 111, 8/115.7, 181

(56) References Cited

U.S. PATENT DOCUMENTS 4,227,881 A * 10/1980 Fono ..... 8/102
5,749,923 A * 5/1998 Olip et al. ..... 8/102

FOREIGN PATENT DOCUMENTS

| | | |
|---|---|---|
| DE | 19708973 | 3/1997 |
| JP | 10-121387 | 5/1998 |
| WO | WO 97/25469 | 7/1997 |
| WO | WO98/03725 | 1/1998 |

OTHER PUBLICATIONS

K. Reinking, et al., Zur Constitution der aldehydschwefligsauren Salze und der hydroschwefligen Säure, Ber. 38, (1905), p. 1079, lines 22–36 (with English Abstract) (1905).

* cited by examiner

*Primary Examiner*—Margaret Einsmann
*Assistant Examiner*—Preeti Kumar
(74) *Attorney, Agent, or Firm*—Oblon, Spivak, McClelland, Maier & Neustadt, P.C.

(57) ABSTRACT

Described is a process for lightening or partially decolorizing vat- or sulfur-dyed textile materials, which comprises treating the material with aminoalkanesulfinic acids in a neutral or weakly acidic medium, and preparations of the aminoalkanesulfinic acids for carrying out this process.

10 Claims, No Drawings

LIGHTENING DYED TEXTILE MATERIAL

This invention relates to a process for lightening or partially decolorizing vat- or sulfur-dyed textile materials, which comprises treating the material with aminoalkanesulfinic acids in a neutral or weakly acidic medium, and to preparations of the aminoalkanesulfinic acids for carrying out this process.

In vat and sulfur dyeing, textile materials comprising cellulosic fibers, such as cotton, linen, hemp or regenerated cellulose fibers such as modal fibers or unmodified viscose rayon, with or without other, especially synthetic, fibers, eg. polyester fibers, for example cotton textiles or cotton-polyester blend textiles, are treated with vatted vat or sulfur dyes in an alkaline medium. After the vatted dye has gone onto the cellulosic fiber, the textile material is rinsed neutral and then reoxidized.

Vatting is the conversion of certain water-insoluble dyes (vat dyes or sulfur dyes) by reduction in an alkaline medium into a water-soluble hydro or leuco compound whose anion has sufficient affinity for fiber composed of natural or regenerated cellulose, for example cotton fiber or rayon. On reoxidation of the leuco compound, for example by exposure to air, the insoluble dye is re-formed in a very finely divided stage in the cellulosic fiber and thus ensures high-grade wash- and crock- and lightfastness.

Vat and sulfur dyes may be applied to textiles at every stage of processing, ie. not only to fabrics, such as wovens, knits and nonwovens, but also to yarns. Textile materials are generally dyed in the form of the unprocessed fabrics; however, it is also perfectly possible to dye garments made of the textile materials mentioned. Vat and sulfur dyes may also be applied by printing. In this case, thickened vats of vat or sulfur dyes are used and the printed material is subjected to a heat treatment, for example by steaming, and subsequently finished as in dyeing.

Yarn dyeing is predominantly practiced to produce textile sheet materials featuring special effects, for example bicolor effects. A well known textile material featuring such a special effect is denim. To produce denim, the yarns which in the later woven fabric will form the warp threads which extend in the longitudinal direction of the woven web are dyed in a certain color, while the yarns for the transverse weft threads are dyed in a different color or are left undyed. The yarns are then woven up on looms.

Hardwearing workwear items and, these days, blue jeans especially are generally manufactured using a coarse cotton fabric (denim), which is customarily dyed with the vat dye indigo. To create the typical appearance of a pair of blue jeans, generally only the warp threads are dyed prior to weaving and the weft is left colorless. After weaving and making up, it is frequently desired that the garment be partially decolorized again. In fact, only exposed areas of the garment are to be decolorized, the seams for example. Moreover, the pronounced color contrast between the dyed warp threads and the colorless weft threads is to be preserved, ie. the latter must not become stained in the course of the lightening process. There is frequently also a desire to achieve a particular visual effect, for example the "used look" or that only exposed, comparatively highly stressed areas are lightened.

The partial subsequent removal of dye can be effected for example mechanically by washing in the presence of pumice, enzymatically by the partial destruction of the cellulose, or chemically by altering or destroying the dye (stripping). A frequent choice is the stonewashing method, where the fabric is treated mechanically with pumice and/or cellulases. Stonewashing is time-consuming and inconvenient, since the pumice stones have to be removed again from the material, and this is at least partly done by hand. The stones are responsible for abrading the equipment and major amounts of sludge arise and have to be disposed of. The visual effect obtained in this way is very good, but the lightening effect is only minimal, so that generally a bleaching process is carried out in addition.

The bleach can be effected enzymatically, oxidatively or reductively.

An ecologically particularly advantageous bleach is the enzymatic bleach by means of laccases which is described in WO 97 25 469. However, laccases are so costly that this process is too uneconomical for everyday textile finishing practice.

The oxidative removal of dyes may be carried out for example using strong oxidizing agents such as alkali metal hypochlorite, ozone or alkali metal permanganate. However, oxidative processes are disadvantageous because of the pronounced fiber damage and, especially in the case of the use of hypochlorites, the unfavorable ecological aspects (AOX).

Despite these disadvantages, oxidative dye destruction today is customarily carried out using hypochlorite.

Reductive removal of vat and sulfur dyes may be effected using various reducing agents, albeit subject to specific restrictions if only partial removal of the dye is desired.

Very strong reducing agents (for example alkali metal dithionite or thiourea dioxide) are unsuitable, since they provide much too rapid and complete, in some instances instantaneous, vatting of many vat dyes, especially indigo, for example. As a result, much too much dye is stripped off in uncontrolled fashion. Weak reducing agents, by contrast, such as glucose or hydroxyacetone, require a relatively high processing temperature, a high pH, ie. a relatively large amount of alkali metal (eg. sodium or potassium) hydroxide, and a high concentration of the reducing agent. In addition, the treatment time is relatively long. Moreover, organic reducing agents, such as glucose, for example, are no longer acceptable in wastewater owing to their high chemical oxygen demand (COD); and the washing until neutral is very costly. Despite these problems, relatively mildly reductive bleaching agents, for example, glucose, are still being used where necessary (JP 96-270034).

The vat dye detached from the warp should not stain the colorless weft threads, which tends to happen under reductive conditions, for example in the presence of alkaline glucose solution. It is therefore customary to include in the wash liquor a backstain inhibitor to control any backstaining by the dissolved dye because the dissolved dye generally has greater affinity for the backstain inhibitor than for the fiber.

An improved reductive bleaching process, using hydroxyalkanesulfinic acids as bleaching agents, is described in DE-A-19 708 973. The disadvantage of this process is that it too has to be carried out in a strongly alkaline medium with its attendant backstaining and the associated low color contrast.

It is an object of the present invention to provide a process for the controlled decolorizing or lightening of vat- or sulfur-dyed textile materials whereby the aforementioned disadvantages are avoided or reduced and whereby an optimum color contrast (washdown effect) is achieved relatively consistently, rapidly and environmentally safely especially in the partial decolorizing (lightening) of denim fabrics.

We have found that, surprisingly, this object is achieved by the textile finishing process of the invention described hereinbelow.

The present invention accordingly provides a process for controlled preferably partial, decolorization (lightening) of vat- or sulfur-dyed or -printed textile material, especially denim fabric, which comprises treating the textile material to be lightened or decolorized with one or more compounds (aminoalkanesulfinates) of the formula I $$R^1_{3-z}N(CR^2R^3—SO_2M)_z \quad (I)$$

where z is 1, 2 or 3, $R^1$ is a) when z is 1 or 2: hydrogen, alkyl of 1 to 18 carbon atoms or $HOCH_2CH_2$, b) when z is 2: additionally OH, and c) when z is 1: either as defined under a) independently for the two $R^1$ radicals or as defined under a) in one instance and as defined under b) in the other, $R^2$ and $R^3$, which may be the same or different, are each hydrogen or alkyl of 1 to 4 carbon atoms subject to the proviso that together they have not more than 4 carbon atoms, and M is one equivalent of a mono- or divalent metal atom, at pH 4–7, followed if desired by an aftertreatment with hydrogen peroxide.

The process of the invention is preferably carried out using compounds of the formula I where z is 2 or 3 especially 3 and also compounds in which $R^1$ is hydrogen or alkyl $R^1$ has not more than 10 especially not more than 4 carbon atoms.

Preference is also given to compounds of formula I where $R^2$ and $R^3$ are independently hydrogen, methyl or ethyl and together have not more than 3 preferably only 2 carbon atoms. Preferred metals M are alkali and alkaline earth metals and zinc. Particular preference is given to compounds of this type in which a combination of the abovementioned preferred features is present, for example a compound of the formula I where $R^1$, $R^2$ and $R^3$ are each hydrogen.

The compounds of the formula I can also be used as individuals. But it is more advantageous to use mixtures of these compounds in which the z indices have different meanings, especially mixtures in which the various compounds are present in that ratio which corresponds to their equilibrium concentration in an aqueous system of compounds of the formula I, the amine or the hydroxylamine of the formula $R^1_{3-z}NH_z$ and a hydroxyalkanesulfinate of the formula $HO—CR^2R^3—SO_2M$, where $R^1$, $R^2$, $R^3$, z and M are each as defined above and the molar ratio of sulfur-containing compounds to nitrogen-containing compounds is in the range from 0.2 to 1.1, preferably from 0.25 to 1.0, especially from 0.3 to 0.5.

It will be appreciated that the process of the invention can also be carried out using mixtures of compounds of the formula I which differ with regard to the meanings of $R^1$ and/or $R^2$ and/or $R^3$.

The aminoalkanesulfinates of the formula I can also be used with advantage in mixture with the corresponding aminoalkanesulfonates, in which case these are present in an aminoalkanesulfinic acid:aminoalkanesulfonic acid ratio of from 3:1 to 1:3, preferably from 1.5:1 to 1:1.5 especially in a ratio of about 1:1.

In a further advantageous embodiment, the textile material is additionally and advantageously concurrently treated with backstain inhibitors and/or dispersants and/or surfactants. These are used in total in an amount of from 0.5 to 10.0 g/l, preferably from 1 to 5 g/l. Backstain inhibitors are effective in particular in preventing the differently colored—or in the case of denim the undyed—weft being (back) stained by the dissolved dye. Examples of backstain inhibitors are polyvinylpyrrolidone, naphthalenesulfonic acid-formaldehayde condensates, oleic acid alkoxylates and fatty acid alkoxylates.

The process of the invention is advantageously carried out at elevated temperature, preferably at 40–100° C., especially at 60–95° C., specifically at 75–90° C., under neutral or weakly acidic conditions, preferably at a pH of from 4 to 7 especially from 5 to 7 and a liquor ratio of from 5:1 to 50:1 preferably from 10:1 to 20:1. The pH may be set using known acids, such as citric acid, acetic acid or phosphoric acid. The pH may be stabilized by adding a buffer system eg. phosphoric acid/alkali metal phosphate or citric acid/alkali metal citrate, typically in an amount of about 2 g/l. The compounds of the formula I are used in a concentration of from 0.001 to 0.3 mol/l, preferably from 0.01 to 0.1 mol/l, based on sulfinate.

Under the processing conditions described, the bleaching time is generally in the range from 5 to 30 minutes, preferably in the range from 10 to 20 minutes, depending on the desired degree of lightening.

The stripping effect of the compounds of the formula I is simple to control. The degree of lightening increases with increasing temperature, with increasing bleaching agent concentration and with decreasing pH. Under strong bleaching conditions, the process of the invention makes it possible to cut the stonewashing time appreciably.

Prior to the process of the invention being carried out, the material which is to be bleached is advantageously desized. A customary enzymatic desizing process may be employed for this purpose, for example. Furthermore, the textile material may be subjected to a stonewashing process prior to bleaching. Stonewashing is customarily carried out using pumice and/or cellulases. However, the bleach may also be carried out together with the stonewashing.

If desired, the textile material bleached according to the invention may additionally be subjected to an oxidative aftertreatment. To this end, the bleached textile material may be treated for example at from 80 to 95° C. and a liquor ratio of from 5:1 to 20:1 (eg. 10:1) with from 2 to 8 g/l (eg. 4 g/l) of 38° Bé sodium hydroxide, from 2 to 5 g/l of 50% by weight hydrogen peroxide and from 0.5 to 5 g/l (eg. 1 g/l) of backstain inhibitor, dispersant and/or surfactant for from 5 to 15 minutes (eg. 10 minutes).

In a further aftertreatment step, the textile material may be aftertreated as usual with softeners.

By way of further simplification of the application process, the solutions of the sulfinates or the solutions of the above-described equilibrium mixtures and/or their mixtures with the corresponding aminoalkanesulfonic acids may also be admixed with process-specific assistants, for example the abovementioned backstain inhibitors, dispersants and/or surfactants. These preparations likewise form part of the subject-matter of the present invention.

The aminoalkanesulfinates of the formula I to be used for the bleaching process of the invention, the above-described equilibrium mixtures and the combination of these chemical entities with the corresponding aminoalkanesulfonates are also useful for preparing discharge prints on dyeings of vat and sulfur dyes. For discharge printing, the neutral or weakly acidic solutions of the sulfinates or the solutions of the above-described equilibrium mixtures and/or their mixtures with the corresponding aminoalkanesulfonic acids are admixed with known thickeners and the thusly obtained discharge print pastes are printed in the desired design on the dyeing to be discharged, subjected to a heat treatment and finished as usual. The process is particularly useful when discharge printing is to be carried out in the neutral or weakly acidic pH range and/or when the desired discharge is not to white but half-tone patterns are to be produced. Useful thickeners for preparing the discharge print pastes include all natural and synthetic substances known for preparing such print pastes, for example carob bean flour, salts of polyacrylic acid or solvent-based thickeners.

The aminoalkanesulfinic acid is prepared according to generally known processes (cf. EP-A-914516), for example by reacting sodium dithionite with 2 mol of an aldehyde or ketone of the general formula $R^2COR^3$, where $R^2$ and $R^3$ are each as defined above, to obtain a mixture of hydroxyalkanesulfinate and -sulfonate, from which the sulfinate may if desired be isolated for further reaction. The sulfinate obtained, but preferably the reaction mixture obtained from the reaction of the aldehyde or ketone with alkali metal dithionite, is condensed with ammonia, an amine or a hydroxylamine of the formula $R^1{}_{3-z}NH_z$, where $R^1$ and z are each as defined above, in a molar ratio of from 0.2 to 1.1, preferably from 0.25 to 1.0, especially from 0.3 to 0.5, in a suitable solvent, preferably in an aqueous medium, if desired at slightly elevated temperature. This produces a solution of the aminoalkanesulfinate or—if the hydroxyalkanesulfinate was not first isolated—of a mixture of aminoalkanesulfinate and aminoalkanesulfonate, from which the aminoalkanesulfonate can be removed (cf. K. Reinking, E. Dehnel, H. Labhardt in Ber. 38, (1905), p. 1069–1080). Advantageously, however, the aminoalkanesulfinates are not isolated from the aqueous solution, nor the sulfonate separated off, and instead the as-obtained reaction mixture is used directly for the process of the invention. These solutions have very good stability in storage and the advantage for the user that the complicated dissolving of a solid substance in water is eliminated and instead the aqueous solution need only be diluted to use concentration. In addition, automatic process control is made possible as a result.

The process of the invention is useful for the partial bleaching (lightening) of dyeings and prints with vat and sulfur dyes. Dyes whose dyeings or prints are bleachable according to the invention are listed in the Colour Index under vat dyes and sulfur dyes. Examples of what is bleachable by the process of the invention are dyeings with indigoid dyes, for example indigo, dibromoindigo, indigocarmine, tetrabromoindigo, tetrachloroindigo or thioindigo; with anthraquinonoid dyes, for example Indanthren Blue BC, Idanthren Brown NG, Indanthren Brilliant Green FFB, Indanthren Brilliant Orange GK, Indanthren Brilliant Orange GR, Indanthren Brilliant Orange RK, Indanthren Brilliant Rose R, Indanthren Brilliant Violet R extra, Indanthren Dark Blue BOA, Indanthren Golden Orange G, Indanthren Gray M, Indanthren Olive Green B, Indanthren Red RK, Indanthren Red FBB or Indanthren Reddish Violet RH; or with sulfur dyes, for example Immedial Pure Blue, with the Hydronblau products particularly important for blue workwear, Indocarbon CL and Sulfur Black T.

The treatment according to the process of the invention is particularly useful for dyeings with indigoid dyes, especially with indigo.

Compared with conventional processes, the bleaching process of the invention has a number of significant advantages.

The bleaching agents of the formula I have a reductive action and are therefore very gentle on the fiber. By working in a neutral to weakly acidic medium there is no need for the otherwise required costly and ecologically unfavorable neutralization.

The aminoalkanesulfinic acids of the formula I and their salts alone or in the embodiments more particularly described above are very useful for the process of the invention, especially because their reactivity is between that of the weak reducing agents, such as glucose or hydroxyacetone, and that of the strong reducing agents, such as hydrosulfite (sodium dithionite) or thiourea dioxide. As a consequence, the dyed textile material is generally decolorized to about 80–90%, especially under the conditions of the present invention, if desired nonuniformly.

The backstaining of dissolved dye, for example indigo, on the fibers especially on any differently colored—or in the case of denim material undyed—weft is minimal in that such a weft is left substantially unstained and, if appropriate, a very good contrast is obtained between warp dyeing and weft. The process of the invention is hence a particularly efficient, simple and economical way of achieving the wash-down effect. This makes the process of the invention especially useful in jeans washing.

Another surprise is that the portion of the vat or sulfur dye, especially the portion of indigo, which has become redeposited on the fiber is easily removable (for example, by an oxidative aftertreatment with hydrogen peroxide) when the bleach is carried out according to the invention. This removal of indigo deposited on the fiber takes place even though hydrogen peroxide alone is not capable of lightening indigo dyeings.

The oxidative aftertreatment with hydrogen peroxide is thus a preferred embodiment of the present invention, which is preferably employed when backstaining is to be minimal, when a concentrated liquor is to be used or when a very high degree of lightening is to be achieved in a single wash.

The invention further provides for the use of aminoalkanesulfinates of the formula I or of the above-described mixtures thereof for, preferably partial, decolorization (lightening) of vat- or sulfur-dyed textile materials.

The present invention further provides for the use of aminoalkanesulfinates of the formula I or of the above-described mixtures thereof for preparing discharge prints especially in the half-tone area.

The example which follows illustrates the invention.

EXAMPLE

A drum washer is charged with 5 kg of desized and stonewashed jean pants, 100 l of water, 2 g/l of an oleic acid ethoxylate and 1.5 g/l of glacial acetic acid, started, heated to 85° C. and at 85° C. with 15 ml of a 50% by weight solution containing equimolar amounts of hydroxymethanesulfinate condensed with 0.33 mol % of ammonia and hydroxymethanesulfonate condensed with 0.33 mol % of ammonia. The pH is 6.2 and in the course of the bleaching process it rises to 6.5 over 15 minutes. Thereafter the bleaching liquor is dropped hot from the rotating drum and the textile material is rinsed once with cold water. Some specimens of the pants thus treated are dried, while the others are treated in a liquor ratio of 10:1 with a liquor containing 5 g/l of 50% by weight hydrogen peroxide, 1 g/l of oleic acid ethoxylate and 4 ml of 38° Bé sodium hydroxide solution at 90° C. for 10 minutes. This is followed by a single rinse with water containing 0.5 g/l of citric acid and 3 g/l of a commercially available soft hand agent, and drying.

All the jean pants treated in the manner described exhibit a conspicuous used look and very good contrast between weft and warp threads. There is no sign whatsoever of damage to the fabric. The inside pockets of the pants not given the oxidative aftertreatment are slightly blue, while the inside pockets of the pants aftertreated with hydrogen peroxide are perfectly white.

We claim:

1. A process for controlled partial decolorization of vat- or sulfur-dyed or -printed cellulosic textile material, which comprises treating the cellulosic textile material to be lightened or decolorized with one or more compounds of the formula I $$R^1_{3-z}N(CR^2R^3—SO_2M)_z \quad (I)$$

where z is 1, 2 or 3, $R^1$ is a) when z is 1 or 2: hydrogen, alkyl of 1 to 18 carbon atoms or $HOCH_2CH_2$, b) when z is 2: additionally OH, and c) when z is 1: either as defined under a) independently for the two $R^1$ radicals or as defined under a) in one instance and as defined under b) in the other, $R^2$ and $R^3$, which may be the same or different, are each hydrogen or alkyl of 1 to 4 carbon atoms subject to the proviso that together they have not more than 0.4 carbon atoms, and M is one equivalent of a mono- or divalent metal atom, at pH 4–7, optionally followed by an aftertreatment with hydrogen peroxide.

2. A process as claimed in claim 1, wherein in one or more compounds of the formula I used z is 3 and $R^1$, $R^2$ and $R^3$ are each hydrogen.

3. A process as claimed in claim 1, utilizing mixtures of compounds of the formula I with the corresponding aminoalkanesulfonates where the ratio of aminoalkanesulfinic acid to aminoalkanesulfonic acid is from about 3:1 to about 1:3.

4. A process as claimed in claim 1, wherein the textile material is additionally treated with one or more further assistants selected from the group consisting of backstain inhibitors, dispersants and surfactants.

5. A process as claimed in claim 4, wherein the ratio of an aminoalkanesulfonate to further assistants is in the range from 20:1 to 5:1.

6. A process as claimed in claim 4, wherein the backstain inhibitor is polyvinylpyrrolidone, oleic acid alkoxylate or fatty acid alkoxylate.

7. A process as claimed in claim 1, wherein the compounds of the formula I are printed in the form of a print paste onto the dyeing to be bleached.

8. A process as claimed in claim 1 wherein in the compounds the z indices have different meanings for preparing discharge prints.

9. A process as claimed in claim 1, wherein the textile material is a denim fabric.

10. A process as claimed in claim 1, which is followed by an aftertreatment with hydrogen peroxide.

* * * * *